US005330240A

United States Patent [19]

Barra

[11] Patent Number: 5,330,240

[45] Date of Patent: Jul. 19, 1994

[54] CLOSED SLING WITH SELF-CINCHING LOOP

[76] Inventor: Philippe Barra, 43 rue Belle Rade, 59240 Dunkerque, France

[21] Appl. No.: 142,852

[22] Filed: Oct. 25, 1993

Related U.S. Application Data

[63] Continuation of Ser. No. 867,833, Apr. 13, 1992, abandoned.

[30] Foreign Application Priority Data

Apr. 11, 1991 [FR] France ..... 91 04441

[51] Int. Cl.[5] ..... B66C 1/18

[52] U.S. Cl. ..... 294/74

[58] Field of Search ..... 294/67.41, 74, 81.55, 294/82.14, 119.2, 149, 150, 157, 164

[56] References Cited

U.S. PATENT DOCUMENTS

| | | | |
|---|---|---|---|
| 1,573,878 | 2/1926 | Smith | 294/74 |
| 1,686,288 | 10/1928 | Meals | 294/74 |
| 2,080,148 | 5/1937 | Naysmith | 294/74 |
| 3,861,734 | 1/1975 | Welch | 294/74 |
| 4,022,507 | 5/1977 | Marino | 294/74 |
| 4,565,399 | 1/1986 | Cranston | 294/74 |

FOREIGN PATENT DOCUMENTS

| | | | |
|---|---|---|---|
| 787322 | 12/1972 | Belgium . | |
| 3703547 | 8/1988 | Fed. Rep. of Germany | 294/74 |
| 612309 | 10/1926 | France . | |
| 1398950 | 4/1965 | France . | |
| 2372736 | 6/1978 | France . | |
| 2436741 | 5/1980 | France | 294/74 |
| 2499521 | 8/1982 | France . | |
| 673583 | 7/1979 | U.S.S.R. | 294/74 |
| 423391 | 1/1935 | United Kingdom | 294/74 |
| 1059070 | 2/1967 | United Kingdom | 294/74 |
| 1409242 | 10/1975 | United Kingdom | 294/74 |

*Primary Examiner*—Johnny D. Cherry

*Attorney, Agent, or Firm*—Stroock & Stroock & Lavan

[57] ABSTRACT

A sling is disclosed, constituted by a metal wire whose two ends are definitively fixed to one another, in particularly by splicing and which forms a cinching loop extending by a lifting loop larger than the preceding one, sliding sleeves connecting these loops together in their adjacent parts close to the load gripped by the cinching loop, characterized in that it comprises at least two lifting loops formed from the same wire as at least one cinching loop.

7 Claims, 3 Drawing Sheets

CLOSED SLING WITH SELF-CINCHING LOOP

This is a continuation of application Ser. No. 07/867,833, filed Apr. 13, 1992, for CLOSED SLING WITH SELF-CINCHING LOOP, now abandoned.

FIELD OF THE INVENTION

The present invention relates to a closed sling with self-cinching loop.

BACKGROUND OF THE INVENTION

A sling of this type is known under the term "cinching". It is constituted by a metal wire, particularly of steel, of which the two ends are definitively fixed to each other; this wire forms a figure-of-eight of which the loops are folded down on each other and joined together, on their common part, by sliding sleeves; the smaller loop is intended to surround the package and to self-cinch thereon when the larger, so-called lifting loop is suspended from a hook, and said package, by weighing thereon, tends to lengthen it by narrowing the smaller, so-called cinching loop.

This sling presents the drawback of consuming substantially double the amount of metal wire of an ordinary endless sling disposed normally, i.e. without a "round turn" around the package. However, its advantages are multiple: it ensures connection of the elements composing the load and avoids slidings of said load, whether it be unitary or composite.

When it is desired to increase the lifting force, the number of slings suspended from the same hook is multiplied and, consequently, as many cinching loops as lifting loops are employed. The drawback of this arrangement is that the consumption of metal wire is excessive and expensive.

It is an object of the present invention to overcome this drawback by proposing a single sling which conserves all the advantages of the multiple slings mentioned hereinbefore, namely self-cinching on the package, facility of placing and removing the sling, increase in the lifting force.

SUMMARY OF THE INVENTION

To that end and in accordance with the invention, the same sling comprises at least two lifting loops formed from the same metal wire as at least one cinching loop.

According to a particularly advantageous embodiment, a ring constituted by the wire whose ends are definitively fixed to each other, is formed as a double figure-of-eight and folded on itself in Z form at the location of the nodes so that the largest end loop and intermediate loop or loops are superposed on one another and on the other smallest end loop, the large loops ensuring lifting and the small, self-cinching.

The means for fixing the ends of the metal wire is located at the top of the cinching loop at its centre.

BRIEF DESCRIPTION OF THE INVENTION

The invention will be more readily understood on reading the following description with reference to the accompanying drawings in which.

DETAILED DESCRIPTION OF THE DRAWINGS

Figure 1:
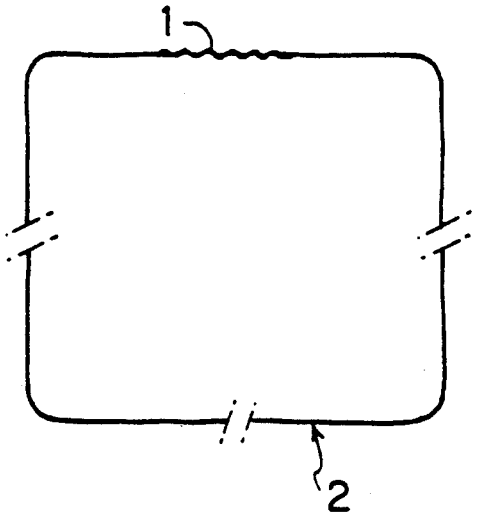
FIG. 1 is a plan view of the basic ring of a sling.

Referring now to the drawings, whatever the embodiment envisaged, the sling is constituted by a single metal wire, advantageously made of steel, whose ends are solidly and definitively fixed together, in particular by means of a splice 1. The pre-blank thus obtained is then a closed ring 2.

Figure 2:
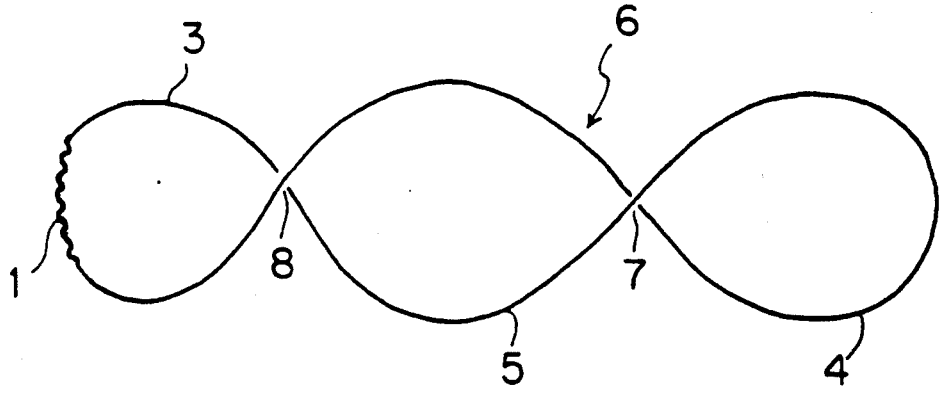
FIG. 2 is a plan view showing the blank of a first embodiment of the sling.

According to the first embodiment shown in FIGS. 2 to 5, the sling comprises a cinching loop 3 and two lifting loops 4, 5 extending from one another without a gap as illustrated in FIG. 2. Loop 3 is intended to be fitted around the package to be displaced and when loops 4 and 5 are taken by the hook of a lifting machine, they cause loop 3 to tighten on the package.

The force of lifting depends on the section of the original wire and corresponds to the sum of the sections of the wire of loops 4 and 5. Of course, the single self-cinching loop 3 cannot break, being given that the development of the sling is continuous.

In order to manufacture the sling from ring 2, a plane blank 6 is formed therewith in the form of a double figure-of-eight, i.e. a geometrical figure with three loops shown schematically in FIG. 2. An end loop and a median loop of the same contour are intended to constitute the two lifting loops 4 and 5 mentioned above, whilst the other end loop; of smaller diameter than the preceding ones, is the self-cinching loop 3.

Figure 3:
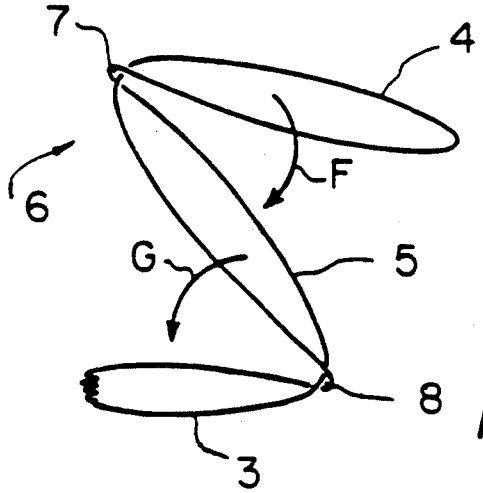
FIG. 3 is a perspective view schematically showing the shaping of the sling from the blank.
Figure 4:
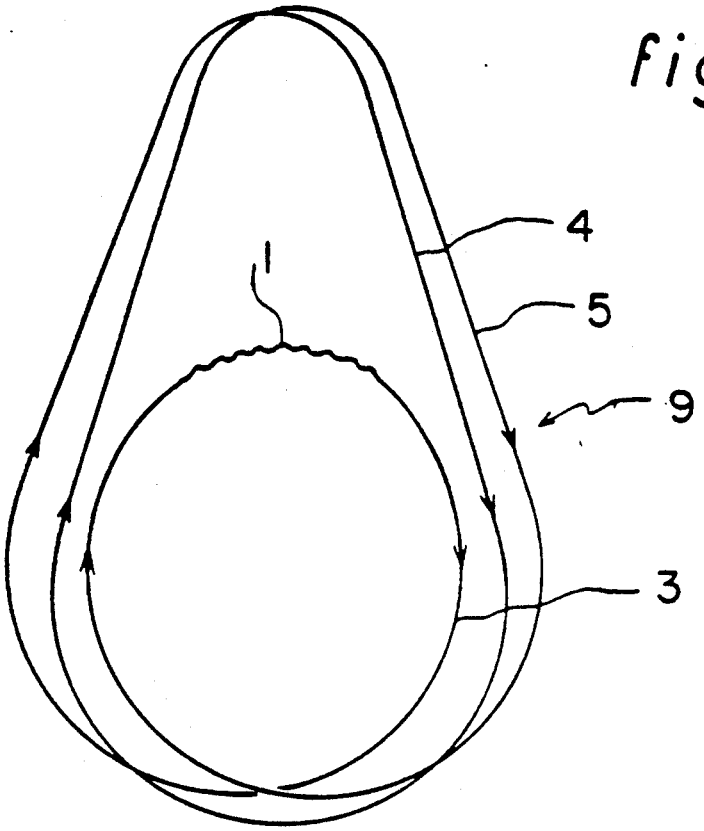
FIG. 4 is a plan view illustrating, with a slight deformation to improve comprehension, the end of shaping, i.e. with the three loops superposed.

The following operation illustrated in FIG. 3 consists in folding the blank 6 in Z form at the location of the intersecting nodes 7 and 8 of loops 3 to 5 in question and in folding, in the direction of arrow F, the loops 4 and 5 on each other and, in the direction of arrow G, these two loops on loop 3, so as to obtain the virtually terminated sling 9 shown, in more or less exploded view for greater clarity, in FIG. 4.

Figure 5:
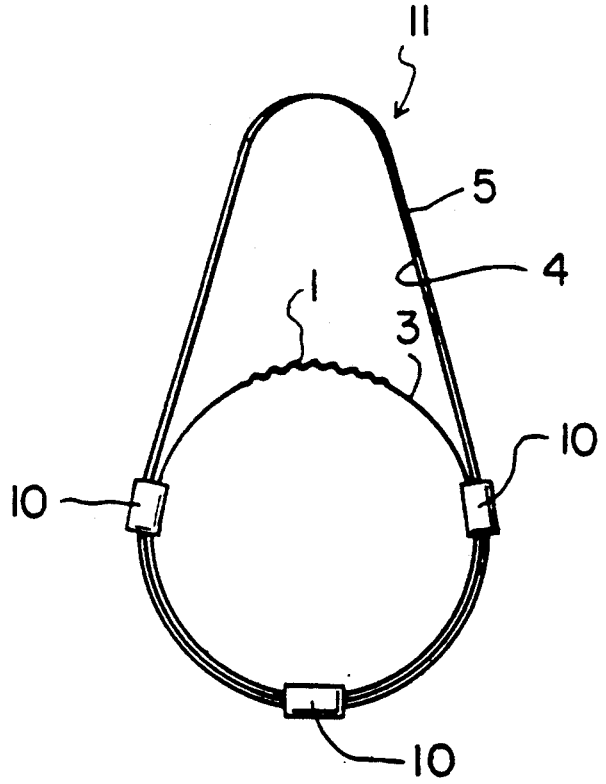
FIG. 5 is a plan view showing the sling obtained after the sliding sleeves have been placed on the sling according to FIG. 4.

In order to ensure resistance of the sling while allowing the cinching loop 3 to tighten as illustrated in FIG. 5, sliding sleeves 10 connect the three loops 3 to 5 in their adjacent parts intended to be in contact with the package and the closed sling 11 shown in FIG. 5 is then obtained. It is important to note that the splice 1 or other fixing means: ligature, clip, clamp, setting sleeve, . . . is located at the top of the cinching loop 3, substantially at its centre.

In general, one cinching loop 3 suffices, but there is nothing to prevent at least two from being provided, braced by means for protecting the package such as small bars and netting.

Figure 6:
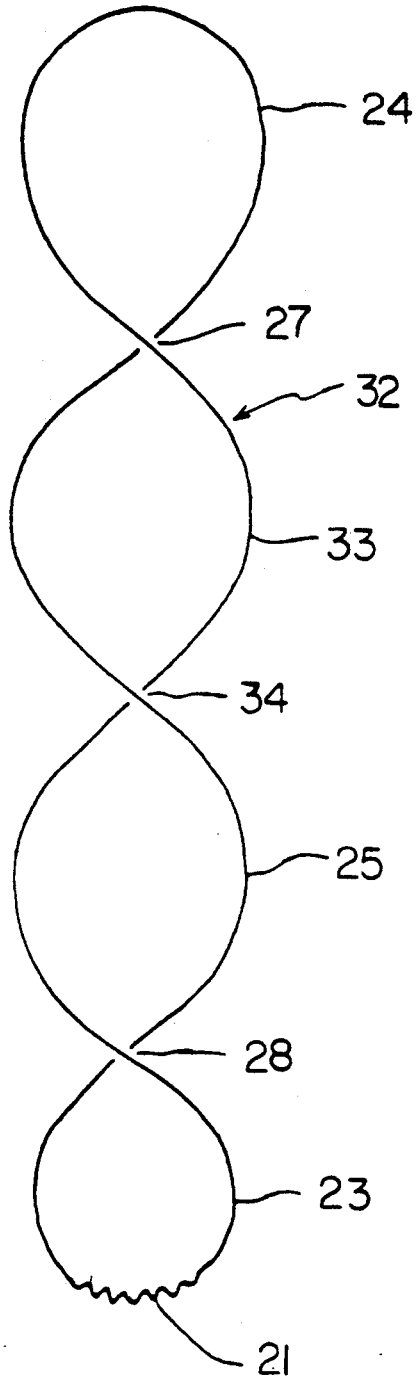
FIG. 6 is a view similar to FIG. 2 showing the blank of a second embodiment of the sling.
Figure 7:
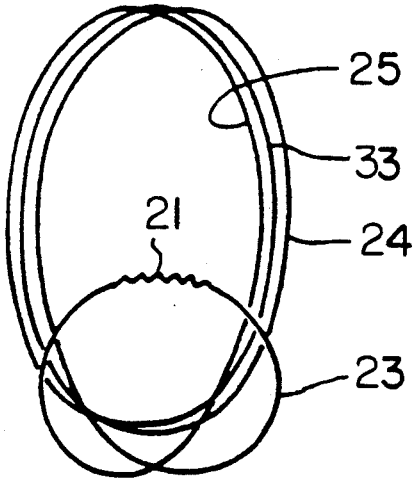
FIG. 7 is a view similar to FIG. 4 concerning this second embodiment.

In the same way, the sling may comprise more than two lifting loops, which is illustrated in the second embodiment according to FIGS. 6 and 7.

In this second embodiment, the blank 32 shown in FIG. 6 comprises three lifting loops 24, 33, 25 and a cinching loop 23 formed in the pre-blank ring 32, which loops are connected together by intersecting nodes 27, 34 and 28 offering no resistance to the slide of the original wire.

As in the first embodiment, the loops of the blank 32 are folded down on one another (FIG. 7) and sliding sleeves 10 (not shown) are placed in position.

What is claimed is:

1. A closed deformable and reusable sling with a self-cinching loop, for lifting a load comprising a length of metal wire with tow ends definitively fixed to one another to form an endless loop, said endless loop forming intercrossed loops lying in substantially parallel planes of orientation to form at least three loops, one of said intercrossed loops being a cinching loop and at least a first lifting loop and a second lifting loop, said at least first and second lifting loops being larger than said cinching loop and superimposed thereon, said cinching loop and said at least first and second lifting loops connected together by sliding sleeves at points along said wire of said loops to allow said cinching loop to tighten around said load, said sliding sleeves located close to said load gripped by said cinching loop.

2. The sling as claimed in claim 1 wherein the ends of the metal wire are located along a circumference of the cinching loop, at a position such that the ends do not contact the first and second lifting loops and are essentially equidistant from the first and second lifting loops.

3. The sling as claimed in claim 1, wherein the wire is made of steel.

4. The method of forming a closed deformable and reusable sling with a self-cinching loop for lifting a load comprising the steps of:

taking a length of metal wire and forming an endless loop by definitively fixing the ends of said wire to each other and forming a plurality of intercrossed loops from sad endless loop by twisting to form a cinching loop, a fist lifting loop and a second lifting loop, said first and second lifting loops being larger than said cinching loop, said cinching loop and said first and second lifting loops lying in substantially the same plane of orientation, said second lifting loop being folded on said first lifting loop and said first lifting loop being folded on said cinching loop such that said cinching loop forms a lower bar of a "Z", said first lifting loop forms the oblique bar of a "Z" and said second lifting loop forms an upper bar of a "Z", said second lifting loop and said first lifting loop being superimposed onto each other, said first and second lifting loops then being superimposed on said cinching loop, said first and second lifting loops insuring lifting and said cinching loop insuring self-cinching.

5. The method of forming a sling as claimed in claim 4, including fixing the ends of the wire such that the ends of the wire are located along a circumference of the cinching loop, at a position such that the ends do not contact the first and second lifting loops and are essentially equidistant from the first and second lifting loops.

6. A closed sling with at least one self-cinching loop for lifting a load, comprising a length of metal wire with two ends definitively fixed to one another to form an endless loop, said endless loop forming intercrossed loops lying in substantially parallel planes of orientation, at least one of said intercrossed loops being said cinching loop and at least two of said intercrossed loops being lifting loops to be suspended from a hook, said lifting loops being of the same contour and larger than said cinching loop and superimposed thereon, said cinching loop and said lifting loops being connected together by short sliding sleeves at points along said wire of said loops, said sliding sleeves establishing a sliding contact between the loops to allow said cinching loop to tighten around said load and being located close to said load gripped by said cinching loop.

7. A continuous, closed, deformable and reusable sling with a self-cinching loop, for lifting a load comprising a length of metal wire with splice means for definitively fixing the ends of the wire to one another to form an endless loop, said endless loop forming at least three intercrossed loops lying in substantially parallel planes of orientation, one of said intercrossed loops being a cinching loop and at least a first lifting loop and a second lifting loop, said at least first and second lifting loops being larger than said cinching loop and superimposed thereon, said cinching loop and said at least first and second lifting loops connected together by sliding sleeves at points along said wire of said loops to allow said cinching loop to tighten around said load with the splice means at the top of the cinching loop, said sliding sleeves located on the sides of said load so that the cinching loop grips the load with the lifting loops sliding within the sliding sleeves so that the cinching loop tightens about the load with the splice means at the top engaging the load.

* * * * *